United States Patent [19]

Anselrode

[11] 4,042,466

[45] * Aug. 16, 1977

[54] METHOD FOR MANUFACTURING A METALIZED SCREEN GAUZE

[75] Inventor: Lodewijk Anselrode, St. Anthonis, Netherlands

[73] Assignee: Stork Brabant B.V., Boxmeer, Netherlands

[ * ] Notice: The portion of the term of this patent subsequent to Aug. 1, 1989, has been disclaimed.

[21] Appl. No.: 646,414

[22] Filed: Jan. 2, 1976

[30] Foreign Application Priority Data

Dec. 27, 1974 Netherlands ..... 7416897

[51] Int. Cl.[2] ..... C25D 1/08

[52] U.S. Cl. ..... 204/11

[58] Field of Search ..... 204/11, 24

[56] References Cited

U.S. PATENT DOCUMENTS

| | | | |
|---|---|---|---|
| 2,213,237 | 9/1940 | Brennan et al. | 204/11 |
| 3,586,609 | 6/1971 | Jansen | 204/11 |
| 3,681,208 | 8/1972 | Anselrode | 204/11 |
| 3,759,800 | 9/1973 | Reinke | 204/11 |

*Primary Examiner*—T. M. Tufariello

*Attorney, Agent, or Firm*—Edmund M. Jaskiewicz

[57] ABSTRACT

Method for manufacturing a metalized screen gauze by a galvanoplastic process, starting from a matrix having an electrically conductive surface upon which a pattern of a non-conductive material has been applied, the method comprising the steps of tensioning a textile web upon said surface and finally performing the galvanoplastic process.

8 Claims, 5 Drawing Figures

METHOD FOR MANUFACTURING A METALIZED SCREEN GAUZE

BACKGROUND OF THE INVENTION

My invention relates to a method for manufacturing a metalized screen gauze starting from a textile product built up of threads, which receives a galvanoplastic treatment. Such a method is known in various versions as will now be explained.

DISCUSSION OF THE PRIOR ART

According to U.S. Pat. No. 3,759,800 and East German Patent Specification 23,490 one has tried to fix the weak spots of the screen gauze, that is to say the crossings of the threads in order to counteract a shift when a paricular mechanical load is applied. For a screen gauze built up of metal wire this is described in the aforementioned U.S. Patent Specification, while for a textile product built up of synthetic threads a method is indicated in the East German Patent Specification mentioned above.

As long as the screen gauze manufactured in this way is used in a flat condition, e.g. as filter or as stencil in flat-bed printing, the screen gauze is tensioned in a frame and the metal layer deposited on the threads and also on the crossings need only be comparatively thin, for being capable of retaining its form. Due to the small thickness of the deposited layer the permeability of the gauze is not too much reduced. The usual thickness of the deposited layer ranges from 5 to 10 μm.

When, however, a cylindrical screen gauze is manufactured e.g. for rotary screen printing, then higher requirements as to the strength of the material should be met. A first requirement is that the gauze is circularly woven or knitted so that no longitudinal seam is present which afterwards becomes visible in printing. Since circular weaving of metal wires is extremely difficult or even impossible one has in practice confined oneself to processing synthetic threads. Such a circularly woven product is commercially available.

After making the synthetic threads conductive and precipitating galvanoplastically a thin metal layer, e.g. copper with a thickness of 1 to 2 μm as intermediate phase, it has been found in practice that starting from a diameter of the synthetic thread of 75 μm at least a nickel layer of 25 μm is required. Only then a screen cylinder is obtained which in use shows strength properties which are to a degree comparable to stencils manufactured in the conventional way from galvanically precipitated nickel, vide e.g. my U.S. Pat. No. 3,354,519. The starting point is a cylindrical metal matrix which is provided with a pattern of non conductive dots on its outer surface. A cylindrical stencil manufactured in this manner has in practice a thickness ranging from 80 to 100 μm.

When the starting point is a textile product consisting of circularly woven threads then by the method referred to above a total maximal thickness of about twice the diameter of the threads plus at least one time the thickness of the nickel layer is obtained that is to say $2 \times 75 + 1 \times 25 = 175$ μm.

It is assumed that no metal is deposited between the surface of the matrix and the textile product for which purpose the product has to be pressed with some tension on the matrix. It is obvious, however, that the considerable thickness of the precipitated metal layer, required for considerations of strength, impairs to a great extent the permeability of the original gauze. This reduces considerably the useful properties of such a screen gauze. Apart therefrom the printing properties of such a thick screen gauze are inferior to those of a thinner gauze.

SUMMARY OF THE INVENTION

My invention aims to provide a method which enables to precipitate a considerably thinner metal layer and yet to obtain a screen gauze with sufficient strength and ability of retaining its form. My starting point is a matrix with an electrically conductive surface to which a pattern of dots of non conductive material is applied, on which matrix the textile product is tensioned, whereupon the galvanoplastic treatment is performed until the threads are anchored in the precipitated metal.

Due to these features a simultaneous deposit of a metal layer is obtained on the threads of the textile product which are conductive or rendered conductive and also on the conductive parts of the surface of the matrix. As a consequence a composite unit is obtained, whereby the gauze as it were is embedded in the basic sieve pattern formed on the matrix itself. This basic metal pattern obtained on the matrix reinforces the sieve obtained from the metal-reinforced tissue.

The starting point is preferably a matrix with a surface which is at least partially cylindrically curved on which the textile product is tensioned before performing the galvanoplastic treatment. So it is possible to use a cylindrical matrix on which a seamless tubular textile product is slid.

In dependence of the final purpose aimed at the pattern on the matrix can be shaped in different ways. Besides dots of hexagonal, circular or square shape, it may be desirable to use a so called grain-pattern consisting of at random arranged dots of arbitrary shape as described in my patent application Ser. No. 615,983 filed on Sept. 23, 1975. The final product will then meet the highest requirements as to avoiding the moire effect.

Under particular circumstances it is advisable to perform the method with a pattern in the surface of the matrix, which has a shape such that after completion of the galvanoplastic treatment a greater strength is imparted to the screen gauze in the direction in which, in use of the gauze, a load greater than the loads in the other directions is applied. In this case it is advisable to use a line pattern whether interrupted or not.

When it is desired to use metalised screen gauze for purposes for which a great strength should be combined with a great permeability then a textile product of non conductive material should be used which prior to the galvanoplastic treatment has been rendered conductive. In that case the screen gauze is simply embedded and partially surrounded by the metal sieve formed on the basic pattern of the matrix. As in that case no metal at all is deposited on the threads, the permeability remains maximal.

SURVEY OF THE DRAWING

FIG. 1 shows a plan view of a woven textile product disposed on the surface of a matrix with a pattern of hexagonal dots provided therein.

The FIGS. 2 to 5 show a cross section through some threads of the textile product with a part of the subjacent matrix.

DESCRIPTION OF PREFERRED EMBODIMENTS

Figure 1:
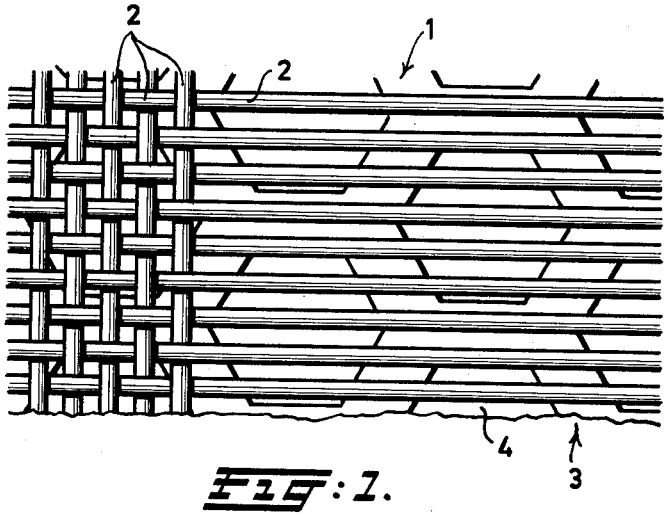
Figure 2:
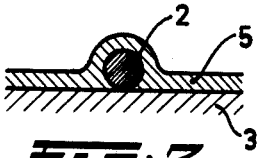
Figure 3:
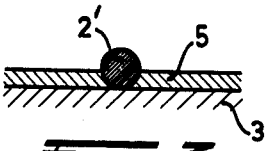
Figure 4:
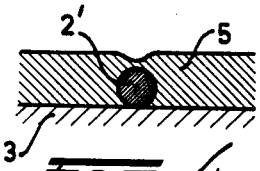
Figure 5:
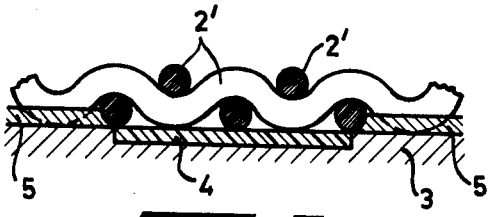

FIG. 1 shows the textile product 2 built up of threads 1, bearing on a matrix 3 provided with a pattern of hexagonal dots 4. The matrix has a cylindrically curved surface or may consist of an entirely circular cylinder in order to permit of the screen gauze 1 being pressed with some vigor on the surface of the matrix 3. The threads 2 may have a surface which is either conductive or not, whereby a difference in the final product will be produced. FIG. 2 shows a metal wire 2 or a synthetic thread provided with a surface that is rendered conductive, while the galvanoplastically precipitated layer 5 has a minor thickness and yet the entire thread 2 is enclosed by the metal. The FIGS. 3-5 relate to the situation which arises when the thread 2' is made of synthetic material and not previously provided with a conductive surface. According to the FIGS. 3-5 the precipitated metal layer 5 is rather thin and the threads 2' due to the cylindrical shape of the screen gauze do not get loose from the embedded position. In the version according to FIG. 4 the galvanoplastic treatment is continued until the precipitated layer 5 is greater than the diameter of the threads 2'. FIG. 5 shows finally how in the area of a non-conductive screen dot 4 of the matrix 3 a maximal permeability between the threads 2' is maintained.

What I claim is:

1. A method of manufacturing a seamless tubular metalized screen gauze comprising the steps of providing a matrix with an electrically conductive surface upon which is a pattern of dots of non-conductive material, tensioning a seamless tubular textile product built up of threads upon the matrix, precipitating metal upon the matrix by a galvano plastic process to anchor the threads in the precipitated metal, and removing the metal reinforced tubular product from the matrix to provide a thin tubular screen capable of use in printing while retaining its form and providing a high proportion of open area.

2. Method according to claim 1, wherein the matrix has a surface which is at least partially cylindrically curved, the textile product being tensioned on the matrix before performing the galvanoplastic treatment.

3. Method according to claim 1, wherein a cylinder is used as a matrix on which the seamless tubular product is slid.

4. Method according to claim 1, wherein the pattern of dots of non-conductive material on the surface of the matrix has a shape such that after completion of the galvanoplastic treatment a greater strength is imparted to the screen gauze in the direction in which, in use of this gauze, a load greater than the load in the other directions is applied.

5. A method according to claim 1, wherein a pattern of non-conductive material is used on the surface of the matrix, said pattern consisting of randomly arranged dots of arbitrary shape.

6. Method according to claim 1, and rendering at least the surface of the threads of the textile product electrically conductive before performing the galvanoplastic treatment.

7. A method according to claim 1, and finishing the galvanoplastic treatment before the thickness of the metal layer precipitated on the matrix is equal to the diameter of the threads of the textile product.

8. A seamless tubular metalized screen gauze formed by providing a matrix with an electrically conductive surface upon which is a pattern of dots of non-conductive material, tensioning a seamless tubular textile product built up of threads upon the matrix, precipitating metal upon the matrix by a galvanoplastic process to anchor the threads in the precipitated metal, and removing the metal reinforced tubular product from the matrix to provide a thin tubular screen capable of use in printing while retaining its form and providing a high proportion of open area.

* * * * *